US011155375B2

(12) United States Patent
Keller et al.

(10) Patent No.: US 11,155,375 B2
(45) Date of Patent: Oct. 26, 2021

(54) STRAPPING APPARATUS HAVING AN ACTUATING ELEMENT FOR THE TENSIONING DEVICE

(71) Applicant: Signode Industrial Group LLC, Glenview, IL (US)

(72) Inventors: Andreas Keller, Birr (CH); Samuel Hochstrasser, Fällanden (CH)

(73) Assignee: Signode Industrial Group LLC, Glenview, IL (US)

( * ) Notice: Subject to any disclaimer, the term of this patent is extended or adjusted under 35 U.S.C. 154(b) by 180 days.

(21) Appl. No.: 16/478,624

(22) PCT Filed: Jan. 29, 2018

(86) PCT No.: PCT/US2018/015717
§ 371 (c)(1),
(2) Date: Jul. 17, 2019

(87) PCT Pub. No.: WO2018/140868
PCT Pub. Date: Aug. 2, 2018

(65) Prior Publication Data

US 2020/0277090 A1 Sep. 3, 2020

(30) Foreign Application Priority Data

Jan. 30, 2017 (CH) ..... 00102/17

(51) Int. Cl.
*B65B 13/22* (2006.01)
*B65B 13/02* (2006.01)
(Continued)

(52) U.S. Cl.
CPC ..... *B65B 13/22* (2013.01); *B65B 13/025* (2013.01); *B65B 13/181* (2013.01); *B65B 13/327* (2013.01); *B65B 57/12* (2013.01)

(58) Field of Classification Search
CPC ..... B65B 13/025; B65B 13/181; B65B 13/22; B65B 13/327; B65B 57/12; B65B 57/00; B65B 23/00
See application file for complete search history.

(56) References Cited

U.S. PATENT DOCUMENTS 3,984,278 A 10/1976 Styner et al.
4,901,775 A 2/1990 Scott et al.
(Continued)

FOREIGN PATENT DOCUMENTS

CN 201411059 Y 2/2010
CN 102026872 A 4/2011
(Continued)

OTHER PUBLICATIONS

Machine Translation of Office Action issued by the Japan Patent Office in connection with JP2019-539895 dated Mar. 2, 2021.
(Continued)

*Primary Examiner* — Andrew M Tecco
*Assistant Examiner* — Nicholas E Igbokwe
(74) *Attorney, Agent, or Firm* — Neal, Gerber & Eisenberg LLP

(57) ABSTRACT

In the case of a strapping apparatus for strapping articles to be packaged with a strapping band, said apparatus having a tensioning device for applying a band tension to a loop of a strapping band, wherein the tensioning device is provided with a tensioning element that is provided to apply a band tension and to engage in the strapping band and is drivable in rotation, and having a connecting device for creating a permanent connection, in particular a welded connection at two regions, located one on top of the other, of the loop of the strapping band, a possibility is intended to be created by way of which damage to articles to be packaged that is attributable to the tensioning operation, and non-uniform
(Continued)

applications of tensile stress to a band loop are avoided or at least reduced. For this purpose an actuating element for the tensioning device is proposed, with which different rotational speeds of the tensioning element are achievable, by way of different intensities of actuation of the actuating element, during the operation of tensioning the strapping band.

16 Claims, 7 Drawing Sheets

(51) Int. Cl.

| | |
|---|---|
| ***B65B 13/18*** | (2006.01) |
| ***B65B 13/32*** | (2006.01) |
| ***B65B 57/12*** | (2006.01) |

(56) References Cited

U.S. PATENT DOCUMENTS

| | | | | |
|---|---|---|---|---|
| 6,483,324 | B1 * | 11/2002 | Mitter | G01N 27/225 324/689 |
| 9,272,799 | B2 | 3/2016 | Figiel et al. | |
| 9,468,968 | B2 | 10/2016 | Figiel et al. | |
| 9,487,314 | B2 | 11/2016 | Finzo | |
| 9,586,708 | B2 | 3/2017 | Finzo | |
| 9,630,265 | B2 | 4/2017 | Figiel et al. | |
| 9,932,135 | B2 | 4/2018 | Finzo et al. | |
| 9,938,029 | B2 | 4/2018 | Finzo et al. | |
| 9,994,341 | B2 | 6/2018 | Amacker et al. | |
| 10,138,010 | B2 | 11/2018 | Skonieczny, Jr. | |
| 10,308,383 | B2 | 6/2019 | Boss et al. | |
| 10,322,831 | B2 | 6/2019 | Nasiatka et al. | |
| 2010/0107573 | A1 * | 5/2010 | Neeser | B65B 13/327 53/589 |
| 2011/0056389 | A1 | 3/2011 | Neeser et al. | |
| 2011/0278035 | A1 * | 11/2011 | Chen | H02P 23/20 173/170 |
| 2012/0210682 | A1 * | 8/2012 | Gardner | B65B 13/345 53/592 |
| 2014/0290179 | A1 | 10/2014 | Keller | |
| 2016/0046398 | A1 * | 2/2016 | Neeser | B65B 13/025 100/2 |
| 2016/0159505 | A1 | 6/2016 | Widmer et al. | |
| 2018/0054033 | A1 | 2/2018 | Skonieczny, Jr. et al. | |

FOREIGN PATENT DOCUMENTS

| | | | |
|---|---|---|---|
| CN | 105173166 | A | 12/2015 |
| CN | 1015173166 | A | 12/2015 |
| EP | 1413519 | A1 | 5/2004 |
| JP | H06301463 | A | 10/1994 |
| JP | 2011518085 | A | 6/2011 |
| JP | 2014-006254 | A | 1/2014 |
| JP | 2014-132922 | A | 7/2014 |

OTHER PUBLICATIONS

Machine translation of Office Action issued by JPO in connection with JP2019-539895 dated Aug. 18, 2020.

Office Action issued by CIPO in connection with CN application 201880006073.8, dated Sep. 29, 2020.

"International Search Report and Written Opinion", European Patent Office, from corresponding PCT/US2018/015717 (11 pages), dated Mar. 29, 2018.

"Second Chinese Office Action", (machine translation) corresponding to Chinese Patent Application No. 201880006073.8, dated May 21, 2021.

"Communication pursuant to Article 94(3) EPC", in connection with European Patent Application No. 18 704 743.6, dated Sep. 23, 2020.

"Official Letter and Search", from corresponding Taiwan patent application No. 107103780, with translation (16 pages), dated Apr. 27, 2021.

"Notice of Termination of Reconsideration by Examiners Before Appeal Proceedings", from corresponding Japanese Patent Application No. 2019-539895, with translation (2 pages), dated Aug. 6, 2021.

"Reconsideration Report By Examiner Before Appeal", from corresponding Japanese Patent Application No. 2019-539895, with translation (8 pages), dated Aug. 3, 2021.

* cited by examiner

STRAPPING APPARATUS HAVING AN ACTUATING ELEMENT FOR THE TENSIONING DEVICE

PRIORITY

This application is a national stage application of PCT/US2018/015717, filed on Jan. 29, 2018, which claims priority to and the benefit of Swiss Patent Application No. CH 00102/17, filed on Jan. 30, 2017, the entire contents of which are incorporated by reference herein.

FIELD

The present disclosure relates to a strapping apparatus for strapping articles to be packaged with a strapping band, said apparatus having a tensioning device for applying a band tension to a loop of a strapping band, wherein the tensioning device is provided with a tensioning element that is provided to apply a band tension and to engage in the strapping band and is drivable in rotation, and having a connecting device for creating a permanent connection, in particular a welded connection, at two regions, located one on top of the other, of the loop of the strapping band.

BACKGROUND

Strapping apparatuses of this kind are used to strap articles to be packaged with a plastics or steel band. To this end, a loop of the particular strapping band is placed around the article to be packaged. Usually, the strapping band is drawn off a supply roll in this case. Once the loop has been placed fully around the article to be packaged, the end region of the band overlaps a portion of the band loop. The portable and mobile strapping apparatus is now applied to this two-layer region of the band, in the process the band is clamped in the strapping apparatus, the band loop is applied to the article to be packaged in a tight manner by way of the tensioning device, and in the process the band loop is provided with band tension. Subsequently, the band loop is closed, for example by a welded joint on the band or by attaching a closing seal. Thereafter, or approximately at the same time, the band loop is separated from the supply roll. As a result, the particular article to be packaged is strapped and generally ready for dispatch.

Strapping apparatuses of the generic type are provided for mobile use, in which the appliances should be carried along to the particular point of use by a user and preferably not be dependent on the use of an external power supply there. The energy required for the intended use of such strapping appliances in order to tension a strapping band about any desired article to be packaged and to create a closure is generally provided, in previously known strapping appliances, by an electric battery or by compressed air. With this energy, the band tension applied to the band by way of the tensioning device and a closure on the strapping band are created. Strapping apparatuses of the generic type are additionally provided to connect only weldable plastics bands together.

In current known strapping apparatuses, there is frequently the possibility of triggering the tensioning operation by actuating a button or some other operating element, said tensioning operation then taking place in an automated manner regardless of any further actuation. In the process, preset values for the duration and for the maximum motor torque and optionally also for the rotational speeds to be set automatically by the controller are worked through. Likewise, there is frequently the possibility of maintaining the operation of tensioning the strapping band by pressing the corresponding actuating button until the actuating button is released again. In both previously known and conventional solutions, there is the problem that in particular pressure-sensitive articles to be packaged can be damaged. Likewise, it is possible, in the case of articles to be packaged which have one or more edges to which the band loop is intended to be applied, for the band loop to be tensioned non-uniformly. In particular in the case of band portions which are arranged at a distance from the strapping appliance and behind such an edge during the strapping operation, there is the risk of such band portions being provided with a much lower band tension than band portions located close to the strapping appliance.

BRIEF SUMMARY

Therefore, the present disclosure is based on the object of creating a possibility, in the case of strapping appliances of the type mentioned at the beginning, by way of which damage to articles to be packaged that is attributable to the tensioning operation, and non-uniform applications of tensile stress to a band loop are avoided or at least reduced.

In the case of a strapping apparatus of the type mentioned at the beginning, this object is achieved according to the present disclosure by an actuating element for the tensioning device, with which different rotational speeds of the tensioning element are achievable, by way of different intensities of the actuation of the actuating element, during the operation of tensioning the strapping band.

The present disclosure thus creates, for strapping appliances, a completely new operating concept for motor-driven tensioning devices of strapping apparatuses. In previous operating concepts, either a tensioning operation executed completely automatically until a predetermined maximum motor current or a particular pneumatic resistance is achieved was triggered by way of an actuation of the actuating element or the tensioning wheel was driven with only one possible predetermined setpoint rotational speed for as long as the actuating element was pressed. In contrast to these previous operating concepts, the present disclosure provides for different rotational speeds of the tensioning wheel or of some other tensioning element, for example a tensioning mandrel, to be settable during a strapping operation by way of different intensities of the actuation of the actuating element for the tensioning device. In this connection, "settable" can preferably be understood as meaning that a controller of the strapping apparatus generates a corresponding control signal for each of these settable rotational speeds and makes it available to the motor. Furthermore, in conjunction with the present disclosure, "intensity of the actuation" can be understood as meaning any possibility for setting an actuating element into different states by varying a physical value. This can be for example different forces applied to the particular actuating element or different lengths of an actuating travel of the actuating element or of part of the actuating element. The above is not an exhaustive list, and it is likewise possible to provide any other change to a physical value which is variable upon actuation of an actuating element.

With such a solution, it is possible, in contrast to previously known solutions, for the operator of the strapping apparatus to apply the strapping band gently to pressure-sensitive articles to be packaged, via a correspondingly suitable actuation of the actuating element and the resultant rotational speed or a range of different rotational speeds. To this end, he can, in particular, bring the band loop initially loosely surrounding the article to be packaged into contact with the article to be packaged at a high band speed. To this end, the operator can actuate the actuating element such that the actuating element covers a greater actuating travel, in particular is pushed through a greater travel. As a result of a greater actuating travel, a greater rotational speed of the motorized drive and as a result a high circumferential speed of the tensioning wheel are preferably also created, with the result that the band is moved quickly. As soon as the strapping band is in contact with the article to be packaged substantially on all sides, the operator can at least partially reset the actuating element again, such that, compared with the starting or zero position of the actuating element, a shorter actuating travel now results in comparison with the preceding greater actuating travel. As a consequence, the tensioning wheel rotates at a slower rotational speed. By varying the actuating travel, the operator is capable of setting, and thus controlling, the rotational speed in each case in a variable manner such that the strapping band is applied to the article to be packaged in a gentle and controlled manner. By releasing and thus completely resetting the actuating element, the operator can stop or end the tensioning operation as soon as the band has been applied to the article to be packaged in a completely tight manner or with the force or tension desired by the operator, but the article to be packaged is not yet damaged.

In an embodiment of the present disclosure, a variation in the intensity of the actuation of the actuating element can include the possibility of actuating the actuating element with actuating travels of different sizes, wherein each particular actuating travel is assigned one of a number of different rotational speeds of the tensioning wheel. Preferably, as the actuating travel increases, the rotational speed also increases. An increase in the rotational speed on account of a rise in the size of the actuating travel can take place in steps or continuously.

In a further variant of the present disclosure, mechanisms may be provided by way of which the actuating element is actuable with different levels of force and in each of these states, the tensioning element is driven on account of the actuation of the actuating element, wherein, depending on the level of force applied to the actuating element, a rotational speed of the tensioning element varies. As a result of the different forces required for different rotational speeds of the tensioning element and the resultant resetting force that acts in each case, the user can be provided with perceptible feedback, from which he can draw a conclusion about the resetting force currently triggered by him in each case. This makes it easier to operate the strapping apparatus in order for it to be possible to set the rotational speed and thus the circumferential speed of the circumferential surface manually in an appropriate manner for each particular situation.

Advantageously, the strapping apparatus according to the present disclosure can be provided with mechanisms, in particular with a sensor element, with which a sensor signal is able to be generated, the value of which is dependent on the intensity of the actuation of the actuating element. This sensor signal is preferably supplied to the controller of the strapping apparatus. The controller can then take the sensor signal, in particular the magnitude thereof, into account when determining the rotational speed of the motor of the tensioning element. Such a sensor element can preferably be arranged in or beneath the actuating element.

Further embodiments are provided with which a rotational speed, corresponding to the intensity of the actuation of the actuating element, of the tensioning element is generated. To this end, the controller can be provided with an algorithm by which either a linear, progressive or degressive increase in the rotational speed of the tensioning wheel takes place in the event of an increase in the intensity of the actuation of the actuating element.

In a further embodiments of the present disclosure, it is also possible for a plurality of actuating elements to be provided, with which the tensioning device is initiated and the rotational speed of the tensioning element is determined. Thus, it is possible for example for a first actuating element for putting the tensioning device into operation to be provided, with which for example a basic rotational speed of the tensioning element is able to be generated by the actuation of said actuating element. With a second actuating element, a variation in the rotational speed of the tensioning element can be achieved by way of different intensities of the actuation of the second actuating element. The second actuating element can be a potentiometer, for example. With a slider or knob, for example, different intensities of the actuation of the potentiometer can be achieved, in order, as a result, to change and set the rotational speed of the tensioning device.

In a further embodiment of the present disclosure, a sensor element for determining the intensity of actuation of the actuating element can be arranged on a carrier element, which absorbs forces acting from the outside, for example forces which occur as a pulling action via the signal cable for the sensor element and which could damage the sensor element. For this purpose, the carrier element can be arranged preferably in a form-fitting manner in a carrier of the strapping apparatus and the signal cable can be fastened to the carrier element. The form fit should in this case be provided at least in those directions in which the expected mechanical loads occur.

Further configurations of the present disclosure can be gathered from the claims, the description and the drawing.

BRIEF DESCRIPTION OF THE SEVERAL VIEWS OF THE DRAWING

The present disclosure is explained in more detail on the basis of exemplary embodiments illustrated purely schematically in the figures, in which.

DETAILED DESCRIPTION

Figure 1:
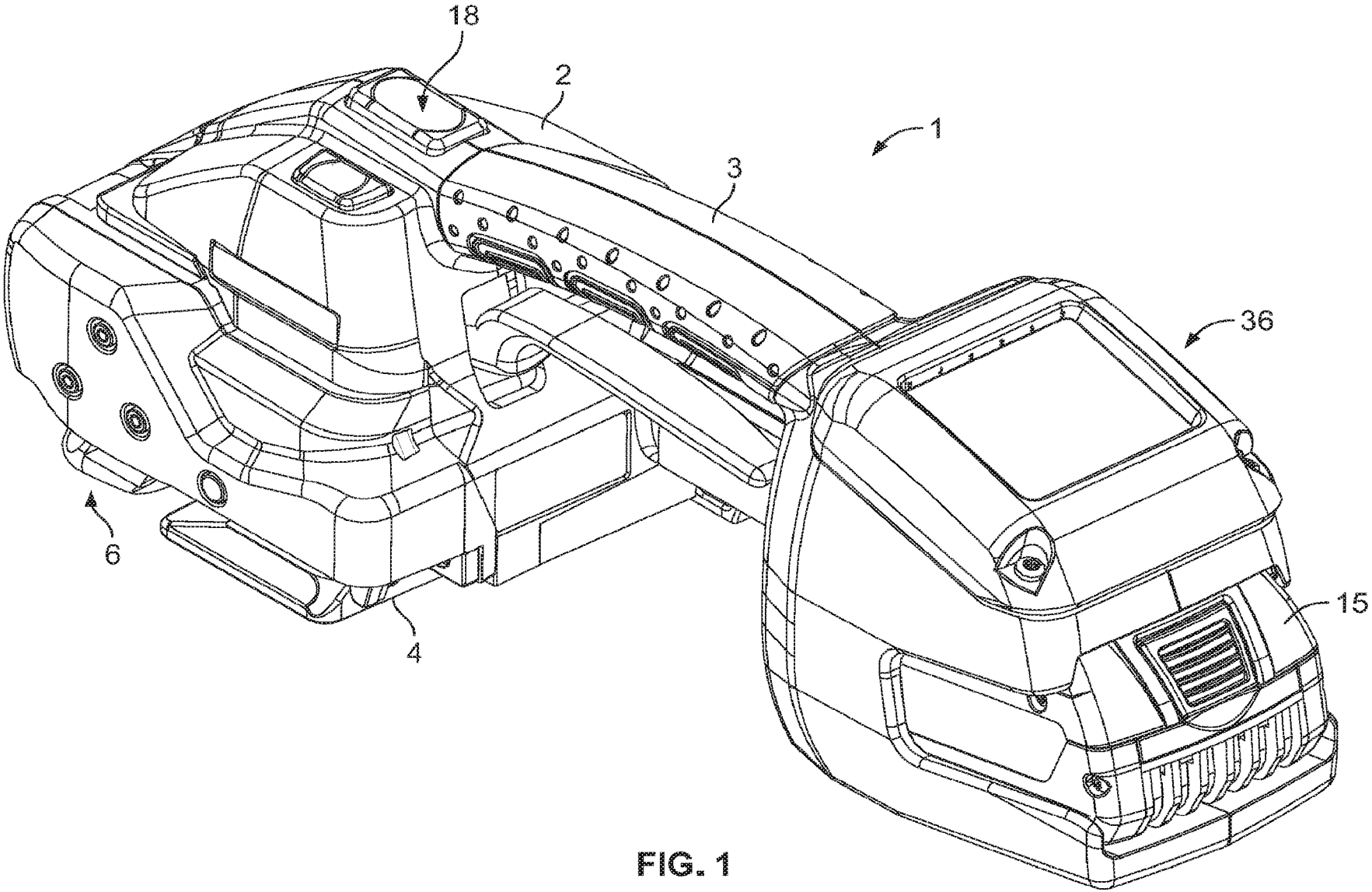
FIG. 1 shows a perspective illustration of a strapping appliance according to the present disclosure.
Figure 2:
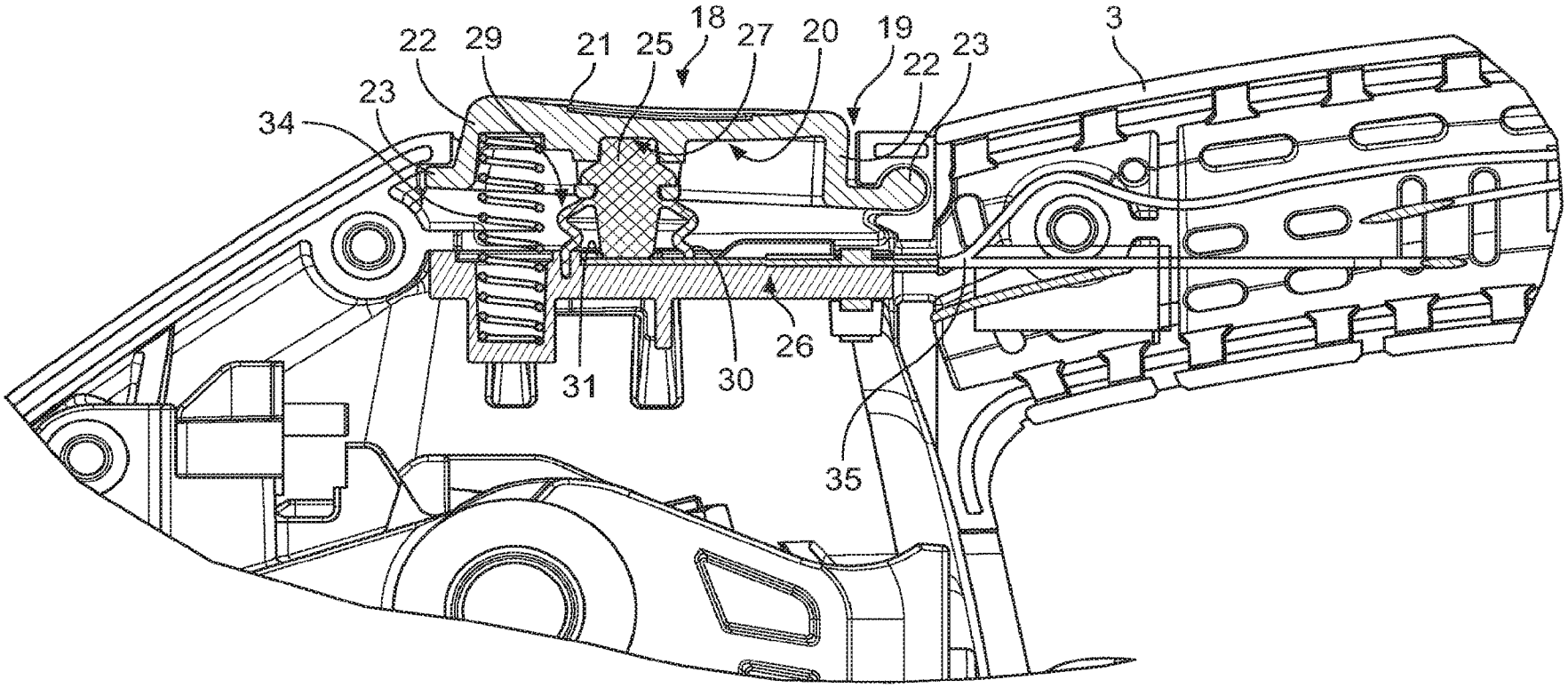
FIG. 2 shows a partial illustration of a longitudinal section through the strapping appliance according to FIG. 1, in which the actuating element and part of a handle are illustrated.

The strapping appliance 1 shown in FIGS. 1 and 2 is mentioned only by way of example for the present disclosure. The description of the specific configuration of the features of the strapping appliance 1 explained below serves merely for the understanding of the present disclosure and does not represent any limitation to embodiments of the present disclosure which would necessarily have to have the following features.

The manually actuated strapping appliance 1 according to the present disclosure that is illustrated here by way of example has a housing 2 which surrounds, inter alia, the mechanism of the strapping appliance and on which a handle 3 for handling the appliance is formed. The strapping appliance is furthermore provided with a base plate 4, the underside of which is provided for arrangement on an item to be packaged. All of the functional units of the strapping appliance 1 are fastened to the base plate 4 and to the carrier (not illustrated in more detail) of the strapping appliance, said carrier being connected to the base plate.

With the strapping appliance 1, a loop (not illustrated in more detail in FIG. 1) of a plastic band B, made for example of polypropylene (PP) or polyester (PET), which has previously been placed around the item to be packaged, can be tensioned by way of a tensioning device 6 of the strapping appliance. In other embodiments of the present disclosure, it is also possible for bands made of other materials, in particular of other plastics or other metal materials, to be processed, wherein, in these embodiments, the particular strapping appliance can be adapted to the band material provided in each case. The tensioning device 6 of the strapping appliance shown here has a tensioning wheel 7, tensioning mandrel or other tensioning element, covered by the housing in FIG. 1, of the tensioning device 6, with which the band B can be captured for a tensioning operation. The tensioning wheel 7 cooperates with a tensioning plate 8 such that the strapping band is able to be clamped between the tensioning wheel 7 and the tensioning plate 8 in order to tighten the strapping band loop, in particular while the tensioning wheel 7 is being driven in rotation, and during this movement, by engagement in the strapping band and retraction thereof, places the latter against the article to be packaged in each case and provides the band of the band loop with band tension.

In the exemplary embodiment, the tensioning plate 8 is arranged on a pivotable rocker (not illustrated in more detail) which can be pivoted about a rocker pivot axis. By way of a pivoting movement of the rocker about the rocker pivot axis, the tensioning plate 8 can be transferred from an end position at a distance from the tensioning wheel 7 to a second end position in which the tensioning plate 8 is pressed against the tensioning wheel 7. By way of a corresponding motor-driven or manually driven movement in the opposite direction of rotation about the rocker pivot axis, the tensioning plate 8 can be moved away from the tensioning wheel 7 and pivoted back into its starting position, with the result that the band located between the tensioning wheel 7 and the tensioning plate is released for removal. In other embodiments of the present disclosure, it is also possible for the tensioning wheel 7 to be arranged on the movable, in particular pivotable, rocker and for the tensioning plate 8 to be arranged in a fixed position.

When the shown embodiment of a tensioning apparatus is in use, provision is made for two layers of the strapping band to be located between the tensioning wheel 7 and the tensioning plate 8 and to be pressed against the tensioning plate 8 by the tensioning wheel 7 or against the tensioning wheel 7 by the tensioning plate. By rotation of the tensioning wheel 7, it is then possible for the band loop to be provided with a band tension which is high enough for packaging purposes.

Subsequently, welding of the two layers can take place, in a manner known per se, by way of the friction welding and separating device 12 of the strapping appliance at a point of the band loop at which two layers of the band are located one on top of the other. As a result, the band loop can be permanently closed. In the exemplary embodiment shown here, the friction welding and separating device 12 is driven by the same only one motor M of the strapping appliance, with which all other motor-driven movements are also carried out. For this purpose, a freewheel (not illustrated in more detail) is provided in a manner known per se in the transmission direction from the motor M to the points at which the motorized drive movement, said freewheel having the effect that the drive movement is transmitted in the drive direction of rotation, provided in each case for this purpose, to the corresponding functional unit of the strapping appliance 1, and no transmission takes place in the other drive direction of rotation, provided in each case for this purpose, of the motor M. Solutions for such single-motor arrangements are previously known for example from the applicant's strapping appliance OR-T 250.

For this purpose, the friction welding device 12 is provided with a welding shoe 14 (not illustrated in more detail) which is transferred, by way of a transfer device 13, from a rest position at a distance from the band into a welding position in which the welding shoe 14 is pressed against the band. The welding shoe 14, which is pressed against the strapping band by mechanical pressure in the process, and the simultaneously performed oscillating movement of the welding shoe 14 with a predetermined frequency, cause the two layers of the strapping band to melt. The locally plasticized or molten regions of the band B flow into one another and, after the band B has cooled, a connection between the two band layers is then formed. If necessary, it is then possible for the band loop to be separated from a supply roll of the band by way of a cutting element (not illustrated in more detail) of the friction welding and separating device 12 of the strapping appliance 1.

The infeed of the tensioning wheel 7 in the direction of the tensioning plate 8, the rotary drive of the tensioning wheel 7 about its tensioning axis, the opening of the rocker with the tensioning wheel 7 or the tensioning plate 8, the infeed of the friction welding device 12 by way of the transfer device 13, and also the use of the friction welding device 12 per se, and the actuation of the separating device, take place using only one common electric motor M, which provides a drive movement for each of these components of the strapping appliance. For the power supply of the motor M, an exchangeable battery 15, which is removable and exchangeable in particular for charging purposes, and which serves for storing electrical energy, is arranged on the strapping appliance. Other external auxiliary energy, such as compressed air or further electricity, for example, may be supplied, but this does not take place in the case of the strapping appliance according to FIGS. 1 and 2. In other embodiments of the present disclosure, however, it is also possible for other forms of energy, in particular compressed air, rather than electrical energy, to be utilized as drive energy.

The mobile portable strapping appliance 1 has three different operating modes. The first mode is an automatic mode in which a complete strapping operation is triggered only by actuating a button 18 or some other switch element. In this automatic mode, after triggering, first of all a tensioning operation by way of the tensioning device 6 and, directly thereafter, a connection between the two band layers of the band loop are formed. Likewise automatically, the band of the loop is separated from the band supply by way of a separating device.

A second mode is a semi-automatic mode. This too, like the automatic mode, can be set by selection by way of a button, switch or some other suitable operating element. In this case, the tensioning operation and the creation of a connection are each initiated separately and one after the other by the operator. The separation of the band from the supply can take place together with the creation of the connection. Both to trigger the tensioning operation and to trigger the connecting operation, it is in each case necessary for the operator to actuate a switch or button or some other actuating element 18.

Finally, a third operating mode is possible, namely a manual mode, which is likewise selectable and settable. In this case, the tensioning operation and the creation of the connection each have to be triggered separately from one another via one or more actuating elements 18. In the exemplary embodiment illustrated, the tensioning device 6 is able to be triggered by way of an actuating element 18 and is maintained for as long as the actuating element 18 is actuated. By releasing the actuating element 18, the tensioning operation can be ended. It is likewise possible to provide for it to be necessary to switch over the function, either by actuating another actuating element or the same actuating element, in order to end the tensioning operation and to release the strapping appliance 1 for the creation of a connection. The connection creation operation can also be maintained for as long as the actuating element of the connecting device is actuated. In the exemplary embodiment, the actuation of the actuating element 18 can be provided for triggering and for maintaining a friction welding operation.

FIG. 2 shows a detail of a longitudinal section through an upper region of the strapping appliance in FIG. 1. FIG. 2 shows in particular the actuating device 18, which is provided, inter alia, for actuating the tensioning device 6. The actuating element 18 is located in the head region of the strapping appliance 1, in the vicinity of the handle 3. The actuating element 18 is located in a cutout 19 in the housing 2. A button body 20 that is adapted to the cross section of the housing is configured in a dome-shaped manner and projects out of the housing cutout 19. The button body 20 is provided with a top portion 21, which is adjoined on all sides by a peripheral region 22. The peripheral region 22 is angled with respect to the top portion 21 and points into the housing 2 of the strapping appliance. The peripheral region 22 is adjoined by a bearing region 23 of the button body 20, which extends at least approximately parallel to the top portion. The bearing region 23 is anchored in the housing. Upon actuation of the actuating element 18, the bearing region 23 remains in its position on the housing 2 as a result, and, upon actuation of the top portion 21 of the actuating element 18 and the associated elastic deformation of the top portion, helps the latter to be restored to its initial form again on account of the resetting force of the resetting element 34. In the exemplary embodiment illustrated, the resetting element 34 is configured as a spring element.

A pressure element 25 is located approximately centrally under the top portion 21 with regard to its longitudinal extent. The pressure element 25 is provided substantially with a cylindrical shape which extends longitudinally between the top portion 21 and a plate-like sensor element 26. A suitable sensor element is for example the product FSR 400 Short sold by the company Interlink Electronics Inc., 31248 Oak Crest Dr, Suite 110, Westlake Village, Calif. 91361, USA. The pressure element 25 can be formed from an elastically deformable material, for example elastomers, silicones, thermoplastics or spring steel. The pressure element 25 is arranged with one of its frontal ends in a receptacle 27 in the underside of the top portion 21 and is anchored therein, such that the pressure element 25 maintains its position with respect to the top portion 21 even when the top portion 21 of the actuating element is loaded. With its other frontal end, the pressure element 25 stands on the sensor element 26. In the unactuated state, the pressure element 25 can also be arranged at a short distance from the sensor element 26 such that there is a small gap between the sensor element 26 and the pressure element 25 in this state.

The pressure element 25 is furthermore provided with a sealing element 29 fitted and arranged at the circumference of the pressure element 25, said sealing element 29 extending in the manner of a bellows in the direction of the sensor element 26. The sealing element 29 stands on the sensor element 26 with a free circumference, which is in the form of a sealing lip 30, and surrounds the end face of the pressure element 25 at a distance therefrom. With a portion of the circumference of the sealing lip 30, the latter is arranged in a carrier element on which a print of the sensor element rests. With the rest of its free circumference, the sealing lip stands on the top side of the sensor element 26. The sealing lip 30 thus surrounds the end face of the pressure element 25 and the sensor surface 31 of the sensor element 26 and seals them off with respect to penetration of dirt particles, moisture and liquids.

A resetting element 34 is likewise provided on the underside of the top portion 21, in a manner offset with respect to the pressure element 25 in the longitudinal direction of the top portion 21. The resetting element 34 is formed by a spring element in the exemplary embodiment, in this case a helical spring element. Therefore, upon actuation of the top portion 21 and the movement of the top portion 21 in the direction of the sensor element 26, not only the pressure element 25 but also the resetting element 34 is compressed. The size of the resetting force in the resetting element 34, said size resulting in proportion depending on the actuating force and the deflection of the top portion 21, causes the top portion 21 to be reset into its starting position as soon as the top portion 21 of the actuating element is released by the user again. If the actuating element is only partially released again, i.e. the user only reduces the intensity of the actuation of the actuating element without completely ending it, the resetting element 34 restores the actuating element 18 as per the degree of the reduction.

Actuation of the top portion 21 of the actuating element 18 thus causes compression of the pressure element 25 and compression of the resetting element 34. In conjunction with one exemplary embodiment of the present disclosure, "compression of the pressure element 25" can be understood as meaning in particular a reversible reduction in the longitudinal extent of the pressure element 25—in this case in the direction of the actuating force. In the exemplary embodiment, "compression" also means that the end side, in contact with the top portion 21, of the pressure element 25 travels in the direction of the sensor element.

The intensity or strength of the actuation of the top portion 21, i.e., in the case of the exemplary embodiment, the size of the force with which the top portion 21 is pressed and is moved in the direction of the sensor element, determines the value of the compression of the pressure element 25 and of the resetting element 34 and thus also the size of the actuating travel of the top portion 21. The value of the compression of the pressure element 25 in turn determines the size of the force with which the pressure element 25 acts on the sensor element 26. On account of the compressibility of the pressure element 25, the latter enlarges its frontal standing surface on the sensor surface 31 of the sensor element 26 in a force-dependent manner, i.e. the surface with which the pressure element 25 is in contact with the sensor element, with a minimum surface pressure being exerted. Depending on the size of the contact surface and in particular on the size of the force acting on the sensor element 26, voltages of different magnitudes are established as sensor signal at the sensor element 26. The variation in the voltage is brought about by a resistance which changes on account of the force application. Thus, depending on the actuating force, introduced into the actuating element 18, on the top portion 21 of the latter, a value, dependent thereon, of the sensor signal is generated. The functional dependence can be for example proportional or logarithmic. A different intensity of the actuation of the top portion 21 thus first of all results in different compression of the pressure element 25 and the latter in turn results in a different magnitude of the sensor signal provided by the sensor element 26.

Figure 3:
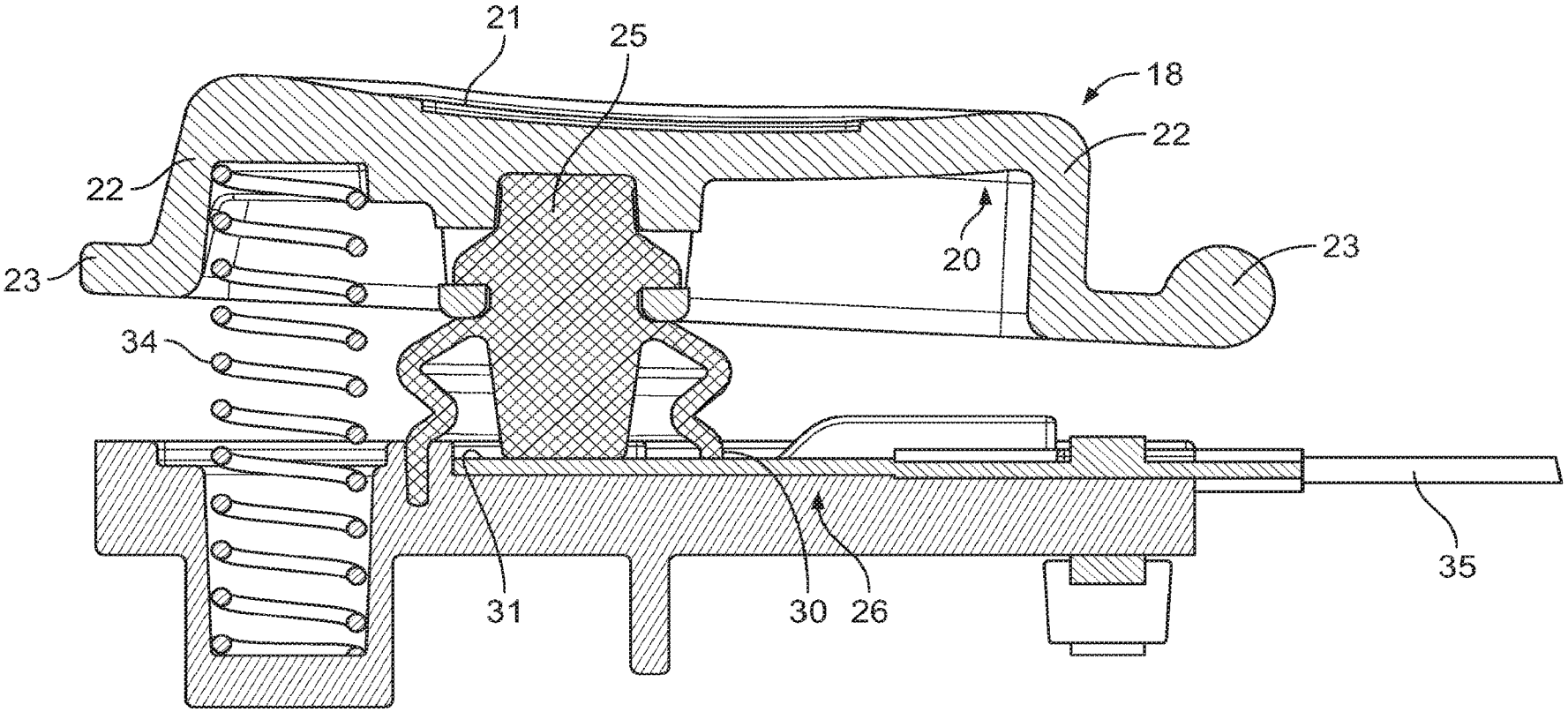
FIG. 3 shows a longitudinal section through the actuating element in FIG. 2.
Figure 4:
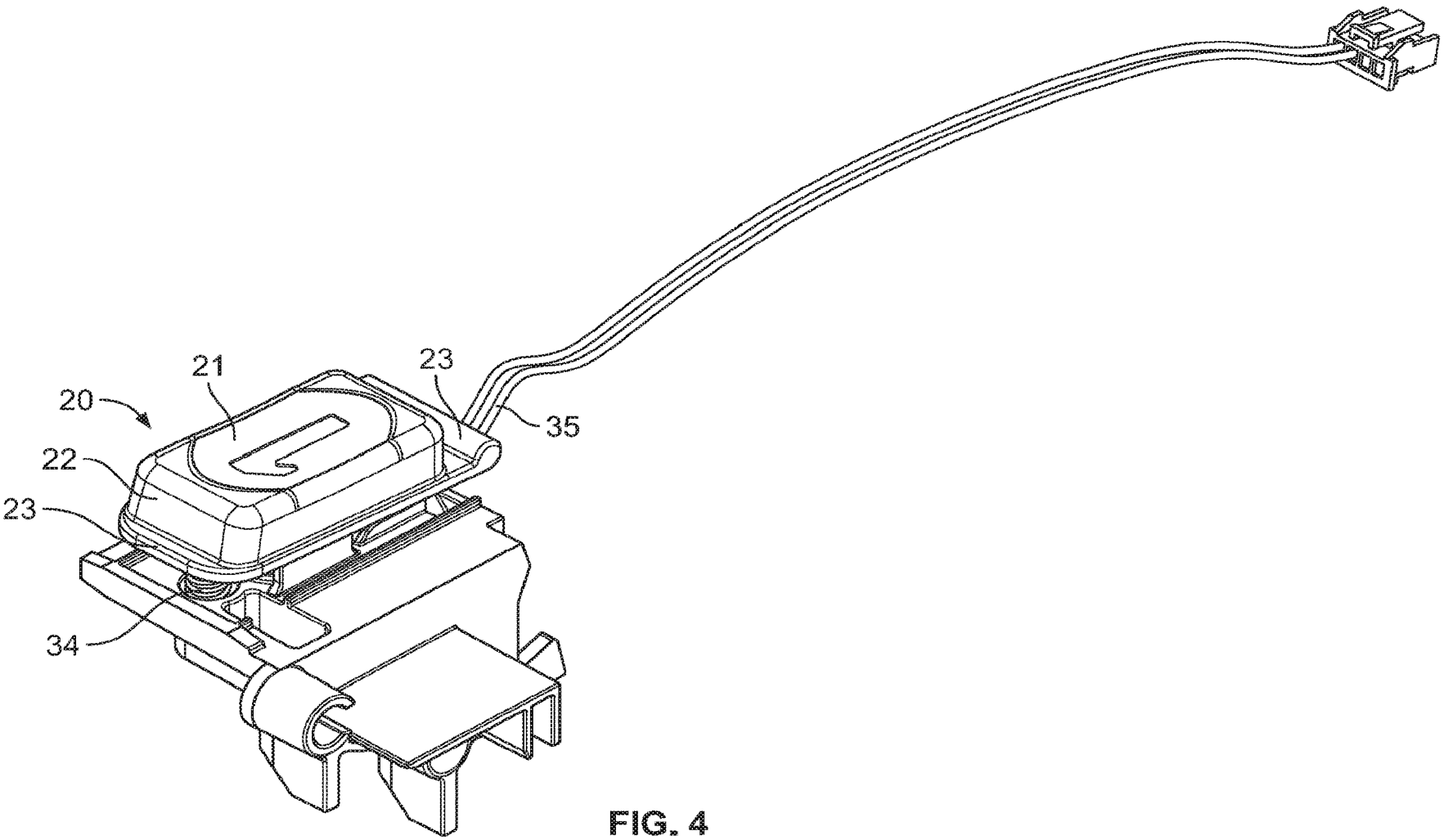
FIG. 4 shows a perspective illustration of the actuating element in FIGS. 2 and 3.
Figure 5:
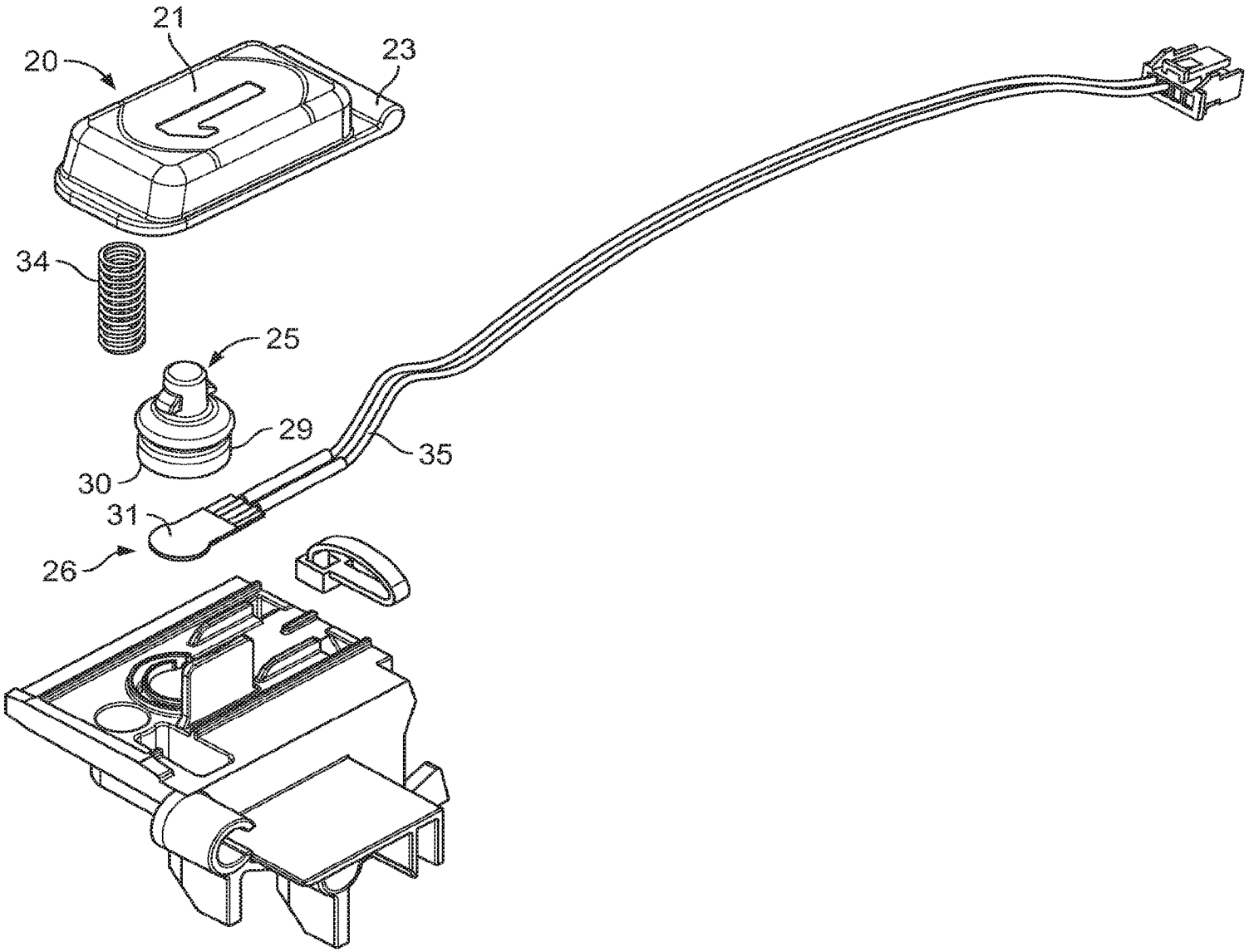
FIG. 5 shows an exploded illustration of the actuating element in FIGS. 2-4.
Figure 6:
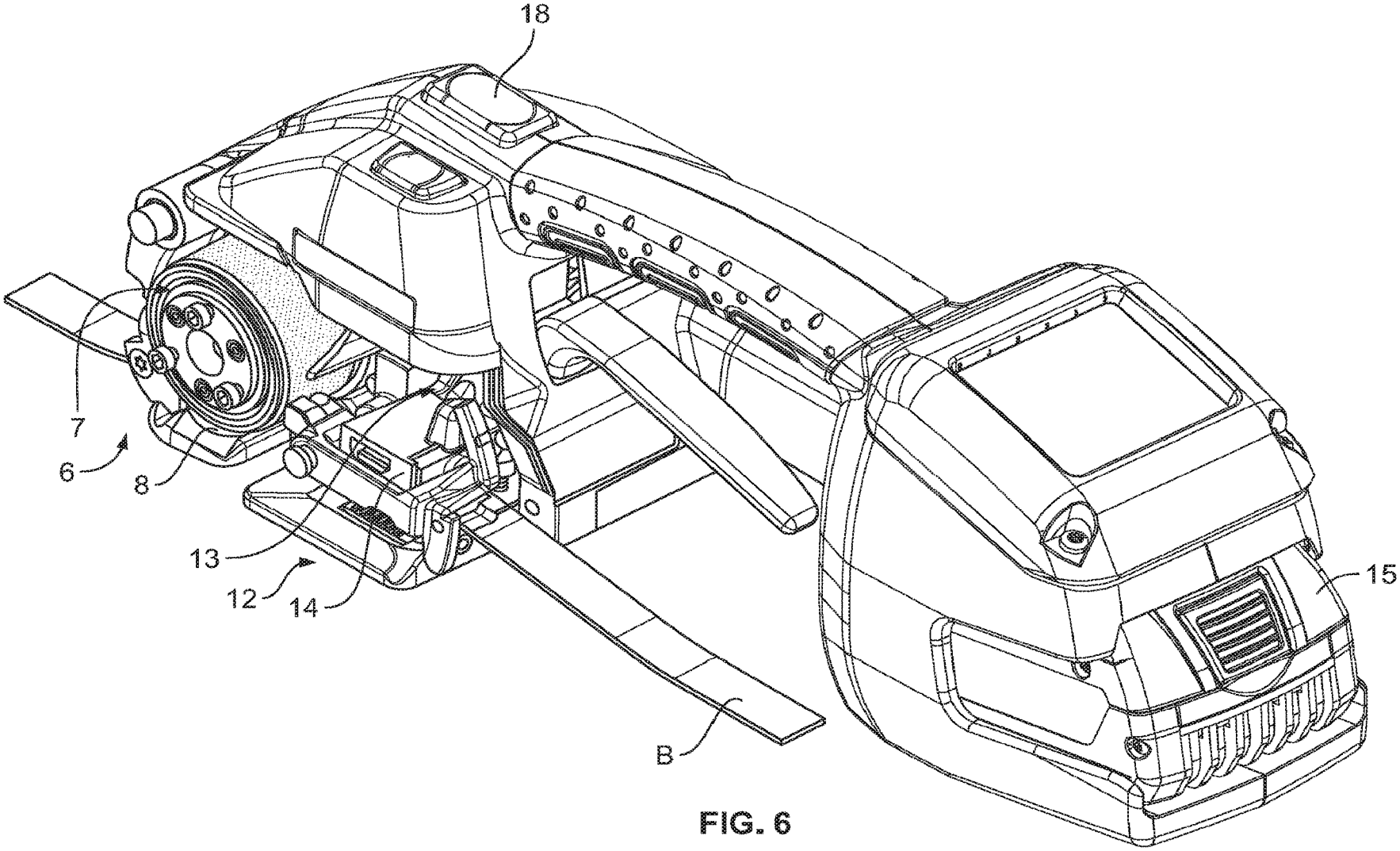
FIG. 6 shows a perspective illustration of the strapping apparatus in FIG. 1 with a housing partially removed in the region of the tensioning device and an inserted strapping band.

As can be seen in FIGS. 3-5, a signal line 35 leads away from the sensor element 26, said signal line 35 connecting the sensor element 26 to a controller of the strapping appliance. In the exemplary embodiment, the controller is located beneath the display/operating device 36 illustrated in FIG. 1. In a manner that is not illustrated, the controller is also connected to the motor of the strapping apparatus, such that, inter alia, the rotational speed of the motor is able to be determined and controlled by way of the controller. In the present case, at least in the manual mode, preferably also in the semi-automatic mode, it is possible, by way of the value of the magnitude of the sensor signal of the sensor element 26, for a particular rotational speed, assigned to this value, of the motor to be set. Actuation with different strengths, i.e. depression of the top portion 21 of the actuating element 18 with different strengths, therefore results in different rotational speeds of the motor and thus also in different rotational speeds of the tensioning wheel 7 and different circumferential speeds of the tensioning wheel. In order to achieve a functionally reliable and immediate reaction of the motor upon a reduction in the intensity of the actuation of the actuating element 18, in the case of such a reduction the top portion is reset by way of the resetting element 34 directly following the reduction and in a manner corresponding to the latter. As a result, the pressure element 25 is also relieved of load in a manner corresponding to the reduction in the actuation and its compression is reduced. This also results in a reduction in the size of the standing surface of the pressure element 25 on the sensor surface 31 and in particular in a reduction in the force exerted on the sensor element by the pressure element 25, this in turn resulting in a reduction in the value of the sensor signal, and in this exemplary embodiment in a reduction in the signal voltage. The result of this is thus a direct adaptation of the rotational speed of the tensioning wheel 7 in the event of a change, in particular also a reduction, in the intensity of the actuation of the top portion and thus of the actuating element.

In the exemplary embodiment, a linear relationship between the actuating travel of the actuating element 18, in this case of its top portion 21, and the rotational speed of the motor can be provided by the controller. In other words, a linear increase or decrease, as seen over the temporal progress thereof, in the actuating travel also results in a linear increase or decrease in the rotational speed of the tensioning wheel and thus also in a linear increase or decrease in the circumferential speed thereof. Just like a linear relationship, any other functional relationship can also be provided between the actuating travel of the actuating element and the rotational speed of the tensioning wheel, for example a progressive or a degressive relationship.

Figure 7A:
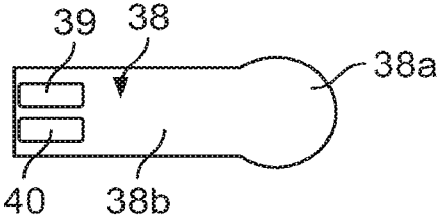
FIG. 7*a* shows a carrier element for a sensor element of the actuating element.
Figure 7B:
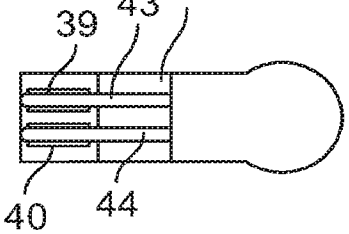
FIG. 7*b* shows the carrier element from FIG. 7*a* on which a print of the sensor element is arranged.
Figure 7C:
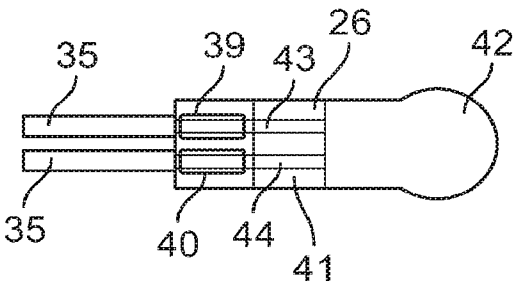
FIG. 7*c* shows the carrier element from FIGS. 7*a* and 7*b*, the contact tracks of which are fastened, together with signal lines, to metal contacts of the carrier element.

FIGS. 7*a*, 7*b* and 7*c* illustrate an alternative embodiment of the sensor element 26, wherein FIGS. 7*a*-7*c* schematically show different stages in the establishment of a sensor element 26 arranged on a carrier element. Here too, a plate-like carrier element 38 is again provided. The latter has, in plan view, an approximately circular portion 38*a* which is adjoined by an approximately rectangular elongate portion 38*b* without a transition. In this case, the diameter of the approximately circular portion 38*a* is greater than the width of the approximately rectangular portion 38*b* of the carrier element 38. Arranged in the region of the free end of the rectangular portion 38*b* are two metal contacts 39, 40 that are arranged in a spaced-apart manner with respect to one another and are fastened to the carrier element 38. The fastening mechanisms of the metal contacts 39, 40, which may also be referred to as solder pads, are in this case provided such that they are able to be subjected to tensile load in a direction parallel to the top side, shown in FIG. 7*a*, of the carrier element 38. One possible fastening mechanism may be for example an adhesive bond, with which in each case one of the metal contacts 39, 40 is fastened to the carrier element 38.

Applied to the carrier element 38 is also the print 41 of the sensor element 26, as is illustrated in particular in FIGS. 7*b* and 7*c*. Just like the metal contacts 39, 40, the print 41 can be adhesively bonded to the carrier element 38. Alternatively, any other conceivable secure connection between the carrier element 38 and the print 41 of the sensor element 26 is also possible. The above-described geometric shape of the carrier element 38 is in this case adapted to the shape of the print 41 of the sensor element 26. The print 41 of the sensor element can in this case correspond to the structure already described above and the described design. In the illustration in FIGS. 7*b* and 7*c*, the print 41 is additionally provided with a protective film 42, for example a Teflon film. Two contact tracks 43, 44 project from the print 41 of the sensor element 26 as far as and over the two metal contacts 39, 40, wherein in each case only one of the contact tracks 43, 44 is located over only one of the two contacts 39, 40. FIG. 7*c* likewise illustrates that in each case (only) one of the two signal lines 35 is also located over each of the two metal contacts 39, 40. In this case, in each case one of the metal contacts 39, 40, the contact track 43, 44, assigned in each case to this metal contact 39, 40, of the sensor element 26, and the signal line 35 likewise assigned to this metal contact are connected together, in particular soldered together. This arrangement results in the advantage that possible tensile loads which act on the contact tracks 43, 44 via the signal line 35 or signal cable are not transmitted to the print 41 of the sensor element 26 but are diverted into the carrier element 38 via the metal contact 39, 40 respectively in question.

Figure 8:
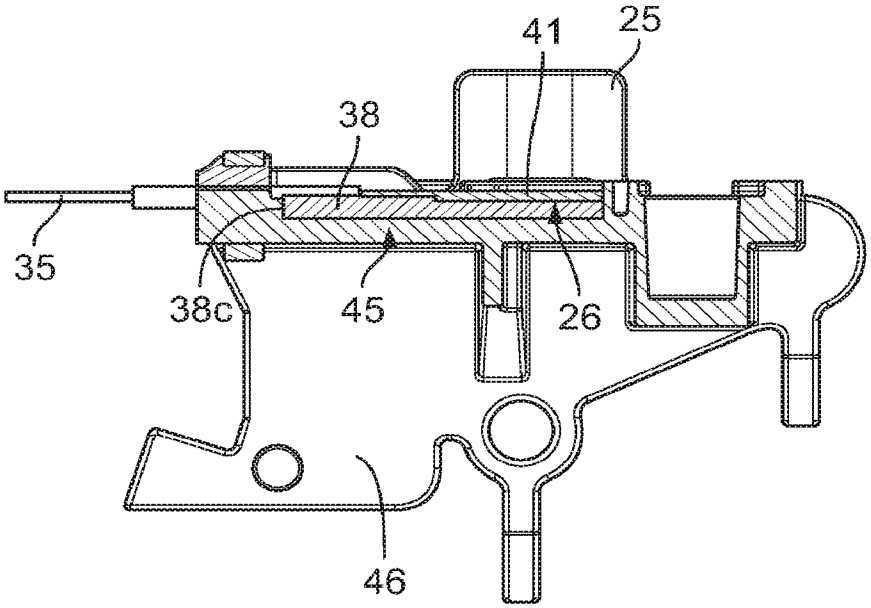
FIG. 8 shows a side view in partial section of a carrier of the strapping appliance, into which a carrier element from FIG. 7*c* has been inserted.

In order to divert the loads from the carrier element 38 into the strapping appliance 1, the carrier element 38 of the sensor element is inserted into a recess 45 in the carrier 46 of the strapping appliance, as is shown in FIG. 8. The recess 45 has a geometric shape which corresponds at least substantially to the geometric shape of the carrier element 38. The carrier element 38 bears against a periphery of the recess 45 of the carrier 46, in particular with its end side 38*c* which is adjacent to the metal contacts 39, 40. In the event of a tensile load introduced into the carrier element 38 via at least one of the signal lines 35 and the corresponding contact 39, 40, the carrier element 38 is pressed with its end side 38*c* against the periphery of the recess 45 and thus the tensile load is diverted into the carrier 46 of the strapping appliance.

As a result of this configuration of one described embodiment of the present disclosure, it is possible for tensile loads introduced via at least one of the signal lines 35, as can occur for example during the assembly or maintenance of a strapping appliance, neither to damage the sensor element 26 nor to result in false measurement results of the sensor. Thus, it is possible, in an easy and yet functionally reliable manner, for the inherently sensitive sensor element 26 to be protected from damage and thus for the functional reliability thereof to be increased.

In order to create band strapping with a plastics band with the strapping appliance 1 according to one embodiment of the present disclosure in its manual mode, the operator places the strapping band loosely as a loop around the particular article to be packaged and introduces the band into the strapping appliance 1 with its band end and a band region overlapping the latter. Once the band has been clamped between the tensioning plate 8 and the tensioning wheel 7, it is possible, in the manual mode of the strapping appliance, to start applying the band loop tightly to the article to be packaged. To this end, the actuating element 18 is started to be pressed, with the result that the motor and thus also the tensioning wheel 7 start running. Since the band is initially arranged only loosely and at a distance from the article to be packaged, the actuating element 18 can be pressed at least approximately along its maximum actuating travel in the direction of the sensor surface 31. As a result, the tensioning wheel 7 rotates at least approximately at the greatest possible rotational speed and reduces the circumference of the loop with the greatest possible speed. As soon as the strapping band is in contact with the article to be packaged, the operator of the strapping appliance can actuate the actuating element with a lower force and as a result partially reset the actuating element 18. As a result, the rotational speed of the tensioning wheel and thus also the value of the band retraction speed are reduced. The operator can thus change, select and set the rotational speed of the tensioning wheel by varying the size of the actuating force exerted manually on the actuating element 18. It is in particular possible, following the previous rapid band retraction and after the band has been brought into contact with the article to be packaged at least approximately on all sides, to tighten the band slowly and thus in a controlled manner. Both the rapid band retraction and also the slower tightening can be controlled manually and carried out in a controlled manner by the operator. As a criterion for ending the tightening, the operator can carry out a visual inspection, for example, and will end the tensioning operation before any damage to the article to be packaged occurs. In particular toward the end of the tensioning operation, in order to reliably avoid damage to the article to be packaged, a further reduction can be provided, for example by way of a successive further resetting of the actuating element and thus a further reduction in the actuating travel, this making it easier to switch off the tensioning device before any damage to the article to be packaged occurs. Such a procedure can be very advantageous for example in the case of pressure-sensitive articles to be packaged, which would be damaged in the case of a preset particular band tension value to be achieved, only at which the strapping appliance is turned off automatically.

The possibility of rotational speeds that are settable in an infinitely variable manner or in a multiplicity of steps by varying the actuating force or other actuating intensity can be advantageous for example also when an edge protector is used. With the present disclosure, it is possible, after a first rapid application of the band to the article to be packaged, to reduce the band retraction speed via the actuating element without turning off the tensioning device, and in the process to bring one or more edge protection elements between the article to be packaged and the band and subsequently to conclude the tensioning operation by way of an appropriate band retraction speed selected in turn via the actuating element. Of course, the same can also be provided in the case of first tensioning carried out with a different relative speed than a rapid first application. In particular in the case of articles to be packaged having a number of edges, a slow band retraction speed selected toward the end of the tensioning operation may be advantageous, this having the result that, in spite of the edges of the article to be packaged, uniform application of the band to the entire circumference of the article to be packaged is achievable. The operator is in this case capable of achieving an improvement in the uniformity of application of the band to the article to be packaged by way of a further reduction in the band retraction speed and thus in the rotational speed, if an initially selected band retraction speed does not lead to the desired result. Likewise, as a result of the present disclosure, the operator is capable of creating enough time to attach edge protectors.

LIST OF REFERENCE NUMERALS

| | |
|---|---|
| 1 | Strapping appliance |
| 2 | Housing |
| 3 | Handle |
| 4 | Base plate |
| 6 | Tensioning device |
| 7 | Tensioning wheel |
| 8 | Tensioning plate |
| 12 | Friction welding and separating device |
| 13 | Transfer device |
| 14 | Welding shoe |
| 15 | Battery |
| 18 | Button/actuating element |
| 19 | Cutout |
| 20 | Button body |
| 21 | Top portion |
| 22 | Peripheral region |
| 23 | Bearing region |
| 25 | Pressure element |
| 26 | Sensor element |
| 27 | Receptacle |
| 29 | Sealing element |
| 30 | Sealing lip |
| 31 | Sensor surface |
| 34 | Resetting element |
| 35 | Signal line |
| 36 | Display/operating device |
| 38 | Carrier element |
| 38a | Approx. circular portion |
| 38b | Approx. rectangular portion |
| 38c | End side |
| 39 | Metal contact |
| 40 | Metal contact |

-continued

| | |
|---|---|
| 41 | Print |
| 42 | Protective film |
| 43 | Contact track |
| 44 | Contact track |
| 45 | Recess |
| 46 | Carrier |
| M | Motor |
| B | Band |

The invention claimed is:

1. A strapping tool comprising:

a tensioning element rotatable to tension a loop of strapping band;

a connecting device actuatable to conned two regions of the loop of strapping band together;

a sensor; and an actuating element comprising a deformable pressure element adjacent the sensor, wherein the actuating element is operably coupled to the tensioning element and actuatable to control a rotational speed of the tensioning element, wherein the actuating element is actuatable with different levels of force that cause the tensioning element to rotate at different respective nonzero rotational speeds, wherein actuation of the actuating element with a first of the levels of force causes the pressure element to contact the sensor and deform to a first extent to establish a first contact surface, wherein actuation of the actuating element with a second of the levels of force greater than the first level of force causes the pressure element to contact the sensor and deform to a second greater extent and establish a second contact surface greater than the first contact surface.

2. The strapping tool of claim 1, wherein the first of the levels of force corresponds to a first rotational speed and the second of the levels of force greater than the first of the levels of force corresponds to a second rotational speed greater than the first rotational speed.

3. The strapping tool of claim 1, wherein a linear relationship exists between the levels of force and the respective rotational speeds.

4. The strapping tool of claim 1, further comprising a controller operably connected to the tensioning element and configured to control rotation of the tensioning element.

5. The strapping tool of claim 4, further comprising:

a motor operably coupled to the tensioning element and configured to rotate the tensioning element;

wherein the sensor is configured to transmit a signal to the controller responsive to contact by the pressure element, wherein the controller is configured to, responsive to receiving the signal, control the motor to rotate the tensioning element at the rotational speed associated with the level of force at which the actuating element was actuated.

6. The strapping tool of claim 5, wherein the sensor is arranged on a carrier element, wherein at least one signal line electrically connected to the sensor is attached to the carrier element.

7. The strapping tool of claim 6, wherein at least one contact track of the sensor is fastened to the carrier element and the at least one signal line and the at least one contact track are arranged on an electrically conductive contact of the carrier element.

8. The strapping tool of claim 1, wherein the pressure element comprises a sealing element that sealingly engages at least part of the sensor.

9. The strapping tool of claim 1, further comprising a housing, wherein the actuating element comprises a bearing region mounted to the housing such that the actuating element is movable relative to the housing between an initial position and a fully-actuated position.

10. The strapping tool of claim 9, further comprising a biasing element that biases the actuating element to the initial position.

11. The strapping tool of claim 9, wherein the actuating element is pivotable about the bearing region and relative to the housing between the initial position and the fully-actuated position.

12. The strapping tool of claim 1, further comprising a controller communicatively connected to the sensor, wherein the sensor is configured to generate and send a signal to the controller responsive to contact by the pressure element, wherein the signal represents a voltage.

13. The strapping tool of claim 12, wherein a magnitude of the voltage is dependent on the size of the contact surface.

14. The strapping tool of claim 13, wherein the first contact surface is associated with a voltage of a first magnitude and the second contact surface is associated with a voltage of a second magnitude that is greater than the first magnitude.

15. The strapping tool of claim 12, wherein the controller is configured to, responsive to receiving the signal, control a motor to rotate the tensioning element at a rotational speed associated with the magnitude of the voltage represented by the signal.

16. The strapping tool of claim 12, further comprising a sealing element that sealingly engages at least part of the sensor.

* * * * *